US010221054B2

(12) United States Patent
Taylor et al.

(10) Patent No.: US 10,221,054 B2
(45) Date of Patent: Mar. 5, 2019

(54) HIGH-STRENGTH COMPOSITE STRUCTURES FOR VEHICLE LIFTS

(71) Applicant: Vehicle Service Group, LLC, Madison, IN (US)

(72) Inventors: Steven H. Taylor, Hanover, IN (US); Brian Kelley, Madison, IN (US)

(73) Assignee: Vehicle Service Group, LLC, Madison, IN (US)

( * ) Notice: Subject to any disclaimer, the term of this patent is extended or adjusted under 35 U.S.C. 154(b) by 89 days.

(21) Appl. No.: 15/235,969

(22) Filed: Aug. 12, 2016

(65) Prior Publication Data

US 2017/0050829 A1 Feb. 23, 2017

Related U.S. Application Data

(60) Provisional application No. 62/207,028, filed on Aug. 19, 2015.

(51) Int. Cl.

| | |
|---|---|
| ***B66F 7/06*** | (2006.01) |
| ***B66F 7/08*** | (2006.01) |
| ***B66F 7/28*** | (2006.01) |

(52) U.S. Cl.

CPC ..... *B66F 7/0666* (2013.01); *B66F 7/08* (2013.01); *B66F 7/28* (2013.01)

(58) Field of Classification Search

None

See application file for complete search history.

(56) References Cited

U.S. PATENT DOCUMENTS

| | | | | |
|---|---|---|---|---|
| 4,175,644 | A * | 11/1979 | Sikli | B66F 3/22 182/141 |
| 4,845,974 | A * | 7/1989 | Bergstrom | B21D 1/14 72/457 |
| 5,096,159 | A | 3/1992 | Fletcher | |
| 5,190,122 | A | 3/1993 | Fletcher et al. | |
| 5,199,686 | A | 4/1993 | Fletcher | |
| 5,636,711 | A * | 6/1997 | Nussbaum | B66F 7/0666 182/141 |
| 6,059,263 | A | 5/2000 | Otema et al. | |
| 6,269,676 | B1 | 8/2001 | Soyk | |
| 6,276,489 | B1 * | 8/2001 | Busuttil | B66F 11/042 182/69.1 |

(Continued)

FOREIGN PATENT DOCUMENTS

| | | | | |
|---|---|---|---|---|
| FR | 3035098 | A1 * | 10/2016 | B66F 3/22 |
| WO | WO 2006033311 | A1 * | 3/2006 | B62D 21/186 |

*Primary Examiner* — Tyrone V Hall, Jr.

(74) *Attorney, Agent, or Firm* — Frost Brown Todd LLC

(57) ABSTRACT

A vehicle lift assembly includes a base, a vehicle engagement member, an actuation assembly, and a lifting linkage assembly. The vehicle engagement member vertically actuates relative to the base member while interfacing with a vehicle in order to lift the vehicle relative to the base member. The actuation assembly drives the vehicle engagement member relative to the base member. The lifting linkage assembly connects the actuation assembly with the vehicle engagement member. The lifting linkage assembly also includes one or more longitudinally extending links, while one or more reinforcement plates are fixed to each of the longitudinally extending links, wherein each reinforcement plate is shorter than the respective link to which it is attached.

20 Claims, 7 Drawing Sheets

(56) References Cited

U.S. PATENT DOCUMENTS

| | | | | |
|---|---|---|---|---|
| 6,405,997 | B1 | 6/2002 | Granata | |
| 6,484,554 | B2 | 11/2002 | Soyk | |
| 6,578,892 | B2 * | 6/2003 | Tsimmerman | B66C 1/105 294/67.21 |
| 6,601,430 | B2 | 8/2003 | McClellan | |
| 6,763,916 | B2 | 7/2004 | Green et al. | |
| 6,811,861 | B2 * | 11/2004 | Bank | E04C 5/07 428/107 |
| 6,983,196 | B2 | 1/2006 | Green et al. | |
| 9,254,990 | B2 | 2/2016 | Matthews et al. | |
| 2006/0284146 | A1 * | 12/2006 | Perham | B66F 7/28 254/45 |
| 2007/0221599 | A1 * | 9/2007 | Player | B66C 23/66 212/179 |
| 2008/0105498 | A1 * | 5/2008 | Perkins | B66F 11/042 187/269 |
| 2008/0187427 | A1 * | 8/2008 | Durney | B21D 5/00 414/722 |

* cited by examiner

HIGH-STRENGTH COMPOSITE STRUCTURES FOR VEHICLE LIFTS

CROSS-REFERENCE TO RELATED APPLICATION

The present application claims priority to and is a non-provisional of U.S. Provisional Application No. 62/207,028, filed Aug. 19, 2015 under the same title.

BACKGROUND

A vehicle lift is a device operable to lift a vehicle such as a car, truck, bus, etc. Some vehicle lifts operate by positioning two or more scissor lift assemblies at or near a shop floor level. The vehicle may then be driven or rolled into position above the two scissor lift assemblies while the scissor lift assemblies are in a retracted position. The scissor lift assemblies may be actuated to extend the height of the scissor lift assemblies, thus raising the vehicle to a desired height. Where two scissor lift assemblies are utilized, the scissor lift assemblies may be positioned at a central location relative to the vehicle's body such that the vehicle may balance on the scissor lift assemblies (e.g., under each axle). Once the user has completed his or her task requiring the vehicle lift, the vehicle may be lowered.

In some instances, the scissor lift assemblies may be actuated by a hydraulic cylinder or other similar device. It may be desirable to modify the structural frame of a lift in order to withstand greater vertical and lateral bending loads. A structural frame may be modified in order to withstand greater bending loads by making a structural element out of thicker material. However, making a structural element with thicker material may require additional, unwanted modifications, such as a wider platform beyond what a vehicle requires or an operator desires. Alternatively, structural elements could be made out of a material with higher strength, although this option may add additional cost or create formability and/or weldability issues. In other alternatives, designers use the tallest link possible, which overcomes some vertical loading, but space constraints limit use and desirability of this approach. In still others, localized, low-strength steel stiffeners are added to the legs, which requires less additional material, but still requires increasing the width of the legs beyond desired constraints. In yet others, a low-strength stiffener with a "P" cross-section is added to the side of each leg (see U.S. Pat. No. 6,405,997 B1, issued Jun. 18, 2002, to Granata), but this complex geometry can yield less than optimal load-carrying improvements for a given added volume.

Therefore, there may be a need to create a scissor lift that may withstand greater bending loads, yet is less wide than a scissor lift of comparable strength that uses thicker material and is cheaper than using higher-strength material for the entire structural element.

Examples of vehicle lift devices and related concepts are disclosed in U.S. Pat. No. 6,983,196, entitled "Electronically Controlled Vehicle Lift and Vehicle Services System," issued Jan. 3, 2006, the disclosure of which is incorporated by reference herein; U.S. Pat. No. 6,763,916, entitled "Method and Apparatus for Synchronizing a Vehicle Lift," issued Jul. 20, 2004, the disclosure of which is incorporated by reference herein; U.S. Pat. No. 6,601,430, entitled "Jack with Elevatable Platform," issued Aug. 5, 2003, the disclosure of which is incorporated by reference herein; U.S. Pat. No. 6,484,554, entitled "Portable Lift and Straightening Platform," issued Nov. 26, 2002, the disclosure of which is incorporated by reference herein; U.S. Pat. No. 6,269,676, entitled "Portable Lift and Straightening Platform," issued Aug. 7, 2001, the disclosure of which is incorporated by reference herein; U.S. Pat. No. 6,059,263, entitled "Automotive Alignment Lift," issued May 9, 2000, the disclosure of which is incorporated by reference herein; U.S. Pat. No. 5,199,686, entitled "Non-Continuous Base Ground Level Automotive Lift System," issued Apr. 6, 1993, the disclosure of which is incorporated by reference herein; U.S. Pat. No. 5,190,122, entitled "Safety Interlock System," issued Mar. 2, 1993, the disclosure of which is incorporated by reference herein; U.S. Pat. No. 5,096,159, entitled "Automotive Lift System," issued Mar. 17, 1992, the disclosure of which is incorporated by reference herein; and U.S. Pub. No. 2012/0048653, entitled "Multi-Link Automotive Alignment Lift," published Mar. 1, 2012, the disclosure of which is incorporated by reference herein.

While a variety of vehicle lifts have been made and used, it is believed that no one prior to the inventor(s) has made or used an invention as described herein.

BRIEF DESCRIPTION OF THE DRAWINGS

While the specification may conclude with claims which particularly point out and distinctly claim the invention, it is believed the present invention will be better understood from the following description of certain examples taken in conjunction with the accompanying drawings, in which like reference numerals identify the same elements and in which:

Figure 1:
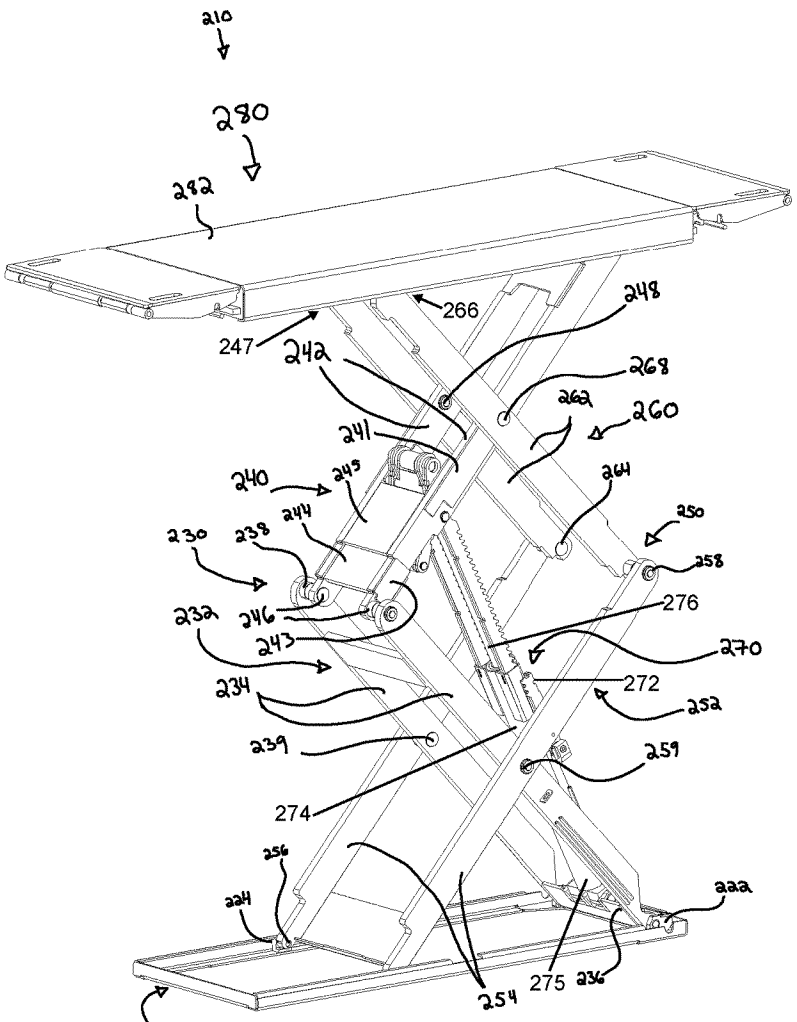
FIG. 1 is a perspective view of an exemplary scissor lift assembly with a modified upper lifting linkage assembly.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the resent invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is, by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Overview of Exemplary Scissor Lift

FIG. 1 shows a perspective view of an exemplary scissor lift assembly (210) in a raised position. A vehicle lift system in some embodiments comprises two scissor lift assemblies (210), a hydraulic pump assembly (not shown), and a synchronizer (not shown). Such a vehicle lift system, including one or more scissor lift assemblies (210), is operable to lift a vehicle to a desired height by actuating the scissor lift assemblies (210) from a retracted position to the extended position shown in FIG. 1. For example, scissor lift assemblies (210) may be positioned to correspond to each axle of a vehicle. Thus, scissor lift assemblies (210) support a vehicle by engaging each axle while raising the vehicle to a desired height. In various embodiments, scissor lift assemblies (210) are actuated by hydraulic actuators (not shown) disposed therein, but in other embodiments different actuation structures will be used as will occur to those of ordinary skill in the art. Of course, it should be understood that any suitable number of scissor lift assemblies (210) may be used in a system. For instance, in some examples four scissor lift assemblies (210) may be used with one scissor lift assembly (210) being positioned at each corner of a vehicle.

Scissor lift assembly (210) comprises a base (220), a set of lifting linkages (230), a set of stabilizing linkages (250), a hydraulic actuator assembly (270), and a platform (280). Base (220) provides a stable platform to which linkages (230, 250) and the rest of scissor lift assembly (210) may mount. Base (220) may be freely movable about a shop floor, fixed in position on a shop floor, or mounted below a shop floor. When scissor lift assembly (210) is in the retracted position, platform (280) may be positioned relatively close to base (220) and thus near a shop floor. Such positioning of platform (280) may permit a vehicle to be driven or rolled over scissor lift assembly (210) prior to initiation of the lifting process. In the present example, base (220) includes a pair of fixed mounting brackets (222) and a pair of slidable mounting brackets (224). Fixed mounting brackets (222) rotatably secure a lower portion of lifting linkages (230) to base (220). Slidable mounting brackets (224) slidably and rotatably secure a lower portion of stabilizing linkages (250) to base (220).

Lifting linkages (230) comprise a lower linkage assembly (232) and an upper linkage assembly (240). Lower linkage assembly (232) comprises two longitudinally extending links (234) and a mounting bracket (236) fixed to the bottom of each link (234). Each link (234) of lower linkage assembly (232) is parallel to the other and is rotatably mounted to base (220) by mounting bracket (236). Mounting bracket (236) also rotatably mounts hydraulic actuator assembly (270) to base (220) such that links (234) and hydraulic actuator assembly (270) are rotatable about a common axis. The upper end of each link (234) comprises a top mounting portion (238), which is operable to rotatably secure each link (234) to upper linkage assembly (240). It should be understood that, while not specifically depicted in FIG. 1, mounting brackets (236) and/or mounting portions (238) may also include bearings, pins, screws, and/or other fasteners configured to facilitate rotatable fastening as will be apparent to those of ordinary skill in the art in view of the teachings herein.

Upper linkage assembly (240) comprises two parallel, longitudinally extending links (242) and a mounting bracket (244). Each link (242) includes a bottom mounting portion (246) and a top mounting portion (247). Bottom mounting portion (246) rotatably secures upper linkage assembly (240) to bottom linkage assembly (230) such that links (242) of upper linkage assembly (240) may pivot relative to links (234) of lower linkage assembly (232). As will be described in greater detail below, top mounting portion (247) rotatably secures links (242) to platform (280). As will also be describe in greater detail below, mounting bracket (244) rotatably secures hydraulic actuation assembly (270) to upper linkage assembly (240). Unlike mounting bracket (236) described above, mounting bracket (244) does not share a common axis of rotation with links (242). Instead, mounting bracket (244) is positioned such that hydraulic actuation assembly (270) may pivot links (242) about an axis defined by bottom mounting portion (246), while simultaneously pivoting links about the axis defined by mounting bracket (236). It should be understood that, while not specifically depicted in FIG. 1, mounting brackets (244) and/or mounting portions (246) may also include bearings, pins, screws, and/or other fasteners configured to facilitate rotatable fastening as will be apparent to those of ordinary skill in the art in view of the teachings herein.

Links (234) of lower linkage assembly (232) and links (242) of upper linkage assembly (240) comprise fastening bores (239, 248). Fastening bores (239, 248) rotatably couple lifting linkages (230) to support linkages (250) such that loads carried by one linkage (230, 250) may be transferred to the other linkage (250, 230). Fastening bores (239, 248) may be configured to support bearings, pins, screws, and/or other rotatable fastening devices as will be apparent to those of ordinary skill in the art in view of the teachings herein.

Stabilizing linkages (250) comprise a lower linkage assembly (252) and an upper linkage assembly (260). Lower linkage assembly (252) comprises two parallel longitudinally extending links (254). Links (254) include a bottom mounting portion (256) and a top mounting portion (258). Each bottom mounting portion (256) rotatably secures the link (254) to mounting brackets (224) on base (220). As was described above, mounting brackets (224) of base (220) are slidable relative to base (220). Accordingly, bottom mounting portions (256) are operable to both slide and pivot links (254) relative to base (220). As will be described in greater detail below, this sliding and pivoting feature of bottom mounting portions (256) permits scissor lift assembly (210) to articulate vertically. Top mounting portions (258) rotatably secure each link (254) to upper linkage assembly (260) such that lower linkage assembly (252) and upper linkage assembly (260) may pivot relative to each other. It should be understood that, while not specifically depicted in FIG. 1, mounting portions (256, 258) may also include bearings, pins, screws, and/or other fasteners configured to facilitate rotatable fastening.

Upper linkage assembly (260), like lower linkage assembly (252), comprises two parallel, longitudinally extending links (262). Links (262) include a bottom mounting portion (264) and a top mounting portion (266). Each bottom mounting portion (264) rotatably secures each link (262) to top mounting portions (258) of lower linkage assembly (252) such that lower linkage assembly (252) and upper linkage assembly (260) are pivotable relative to each other. Top mounting portions (266) rotatably secure each link (262) to a mounting bracket (not shown) of platform (280). The mounting brackets of platform (280) are similar to mounting brackets (224) of base (220) in that the mounting brackets of platform (280) are slidable relative to platform. Thus, top mounting portions (266) are operable to both pivot and slide links (262) relative to platform (280). The sliding and pivoting action of top mounting portions (266) is operable to permit scissor lift assembly (210) to articulate vertically. It should be understood that, while not specifically depicted in FIG. 1, mounting portions (264, 266) may also include bearings, pins, screws, and/or other fasteners configured to facilitate rotatable fastening.

Both links (254) of lower linkage assembly (252) and links (262) of upper linkage assembly (260) comprise fastening bores (259, 268). As will be described in greater detail below, fastening bores (259, 268) rotatably couple lifting linkages (230) to support linkages (250) such that loads carried by one linkage (230, 250) may be transferred to the other linkage (250, 230). Fastening bores (259, 268) may be configured to support bearings, pins, screws, and/or other rotatable fastening devices as will be apparent to those of ordinary skill in the art in view of the teachings herein.

Platform (280) is generally shaped as a longitudinally extending rectangle and includes an upper surface (282) and an open bottom (not shown). Upper surface (282) may be configured to support an axle of a vehicle. Upper surface (282) is shown as generally flat, although it should be understood that in other examples upper surface (282) may have any other suitable shape or may contain other features configured to support an axle of a vehicle. For instance, in some examples upper surface (282) includes an adapter device, which may be selectively actuated by a user so that upper surface (282) may adapt for use with axles of different shapes and/or sizes. In yet other examples, upper surface (282) includes a fixed geometry comprising annular indentations, which may be configured to support a specific axle shape and/or size. Of course, upper surface (282) may include any other features suitable for supporting an axle as will be apparent to those of ordinary skill in the art in view of the teachings herein.

The bottom of platform (280) houses the mounting brackets of platform (280) described above. Additionally, in some embodiments, the bottom of platform (280) includes a track or sliding feature suitable to permit the mounting bracket that connects to top mounting portion (266) to slide relative to platform (280). The bottom of platform (280) is open such that top mounting portions (247, 266) are recessed inside of platform (280). In other examples, the bottom of platform (280) may be closed, and the mounting brackets of platform (280) may be disposed on the outside of platform (280).

Hydraulic actuator assembly (270) comprises a locking mechanism (272) and a hydraulic actuator (274). Locking mechanism (272) is configured to successively lock scissor lift assembly (210) as it is articulated vertically, preventing scissor lift assembly (210) from inadvertently lowering. In other words, as scissor lift assembly (210) is articulated upward, further upward articulation is permitted, yet articulation in the downward direction is prevented by locking mechanism (272). Some non-limiting examples of suitable locking mechanisms (272) have previously been described in U.S. Pub. No. 2012/0048653, entitled "Multi-Link Automotive Alignment Lift," published Mar. 1, 2012, the disclosure of which is incorporated by reference herein.

In an exemplary mode of operation of scissor lift assembly (210), the articulation sequence is initiated by actuating hydraulic actuator (274), thus driving elongate arm (276) outwardly away from hydraulic cylinder (275). Mounting brackets (236, 244) are thus forced in away from each other. Because mounting bracket (236) is in a relatively fixed position, mounting bracket (244) is pushed upwardly relative to base (220). Links (234, 242) are thus pivoted relative to each other and relative to base (220), driving platform (280) upwardly in the vertical direction.

As described above, links (234, 242) of lifting linkages (230) are rotatably secured to links (254, 262) of stabilizing linkages (250) via fastening bores (239, 248, 259, 268). Because of this, the lifting force imparted upon links (234, 242) by hydraulic actuator (274) is also imparted upon links (254, 262). Thus, upward motion of lifting linkages (230) also results in upward motion of stabilizing linkages (250), which in turn results in upper surface (282) of platform (280) being raised while maintaining a substantially horizontal orientation. This lifting process continues until platform (280) is raised to a desired height.

II. High-Strength Composite Structure

Figure 2:
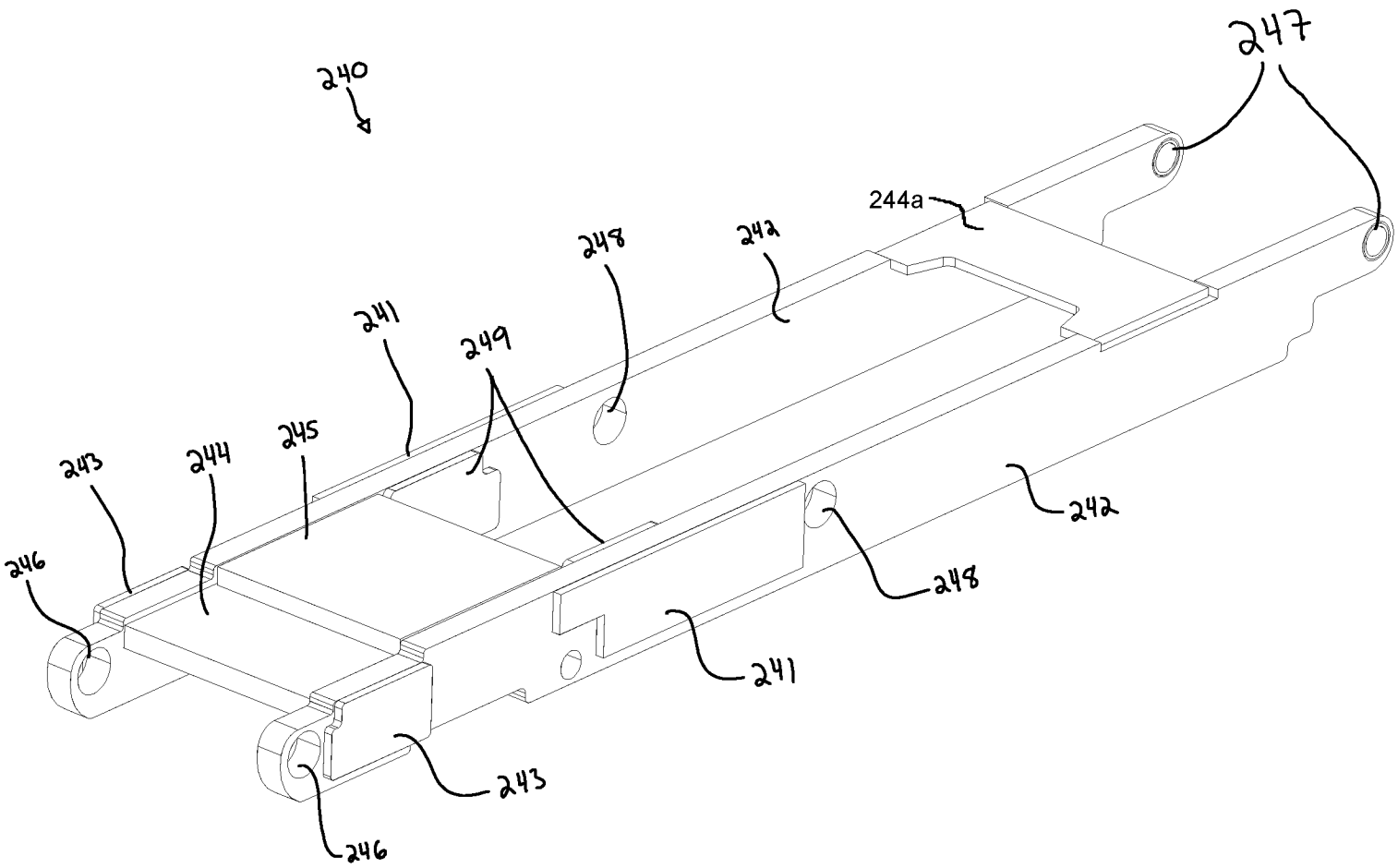
FIG. 2 is a perspective view of the upper lifting linkage assembly of FIG. 1.
Figure 3:
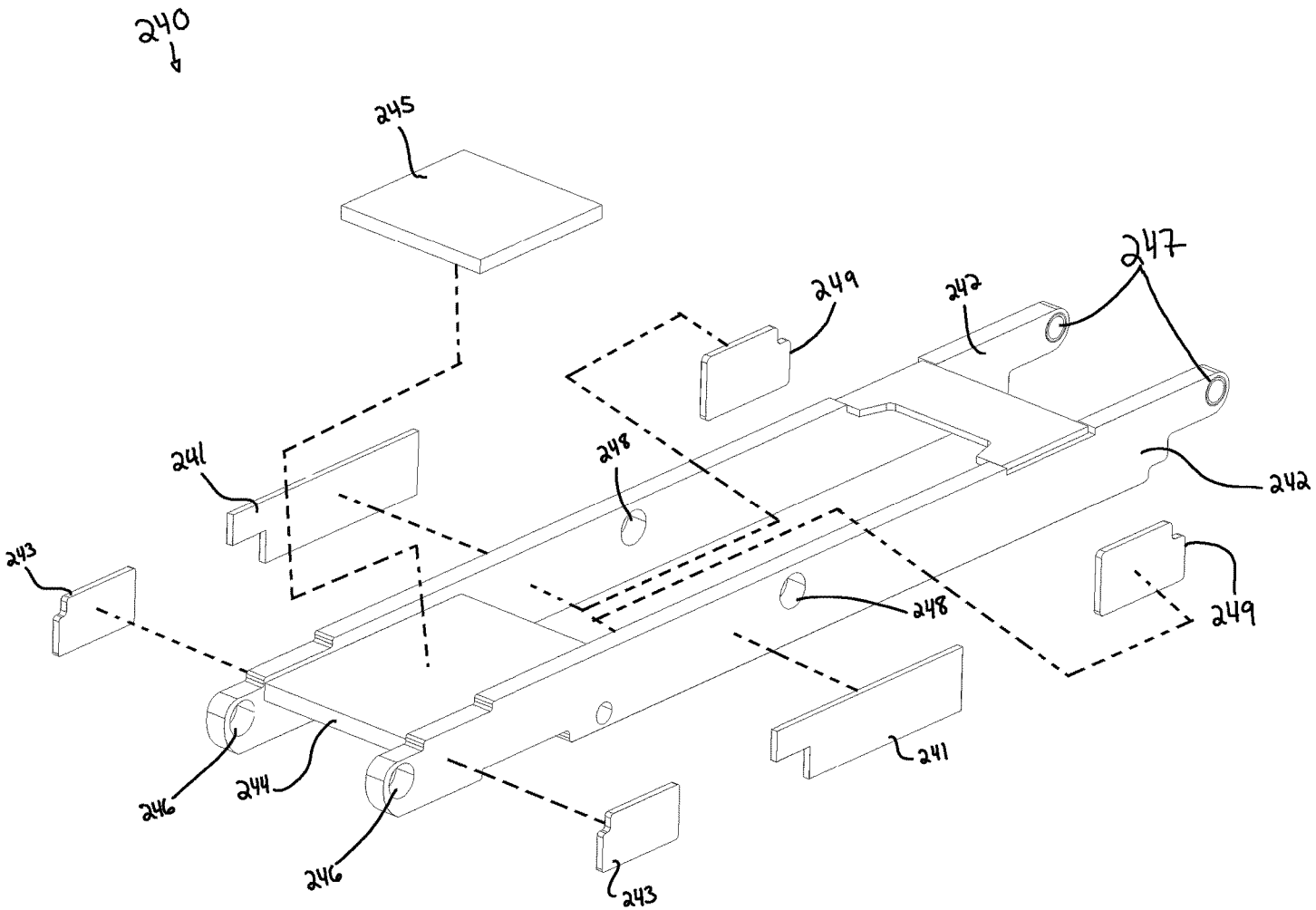
FIG. 3 is an exploded view of the upper lifting linkage assembly of FIG. 1.

Turning to FIGS. 2-3, with continuing reference to FIG. 1 for context, upper linkage assembly (240) is illustrated, including longitudinally extending upper links (242) joined by mounting brackets (244, 244*a*), each link (242) having a top mounting portion (247) and a bottom mounting portion (246). High-strength reinforcement plates (241, 243, 245, 249) add to the structural strength and stability of scissor lift assembly (210). In particular, reinforcement plate (241) is affixed on the outer side of each of upper links (242) just below the fastening bore (248). Reinforcement plate (243) is likewise affixed on the outside of each of upper links (242), just above mounting portions (246). Reinforcement plate (245) is affixed to mounting bracket (244) and, like it, bridges the space between the upper links (242). In various embodiments, while structural components of scissor lift assembly (210) might be made of lower-strength steel, reinforcement plates (241, 243, 245, 249) are made of a higher-strength material such as higher-strength steel. Of course, other materials will occur to those of ordinary skill in the art in the context of particular applications of this invention. Attachment of the respective reinforcement plate (241, 243, 249) in position on the respective upper link (242), or attachment of reinforcement plate (245) between a pair of upper links (242) along one surface of mounting bracket (244), may be by welding, adhesive, or other techniques as will occur to those of ordinary skill in the art. FIG. 3 shows additional detail regarding the position and configuration of reinforcement plates (241, 243, 245, 249).

Figure 4:
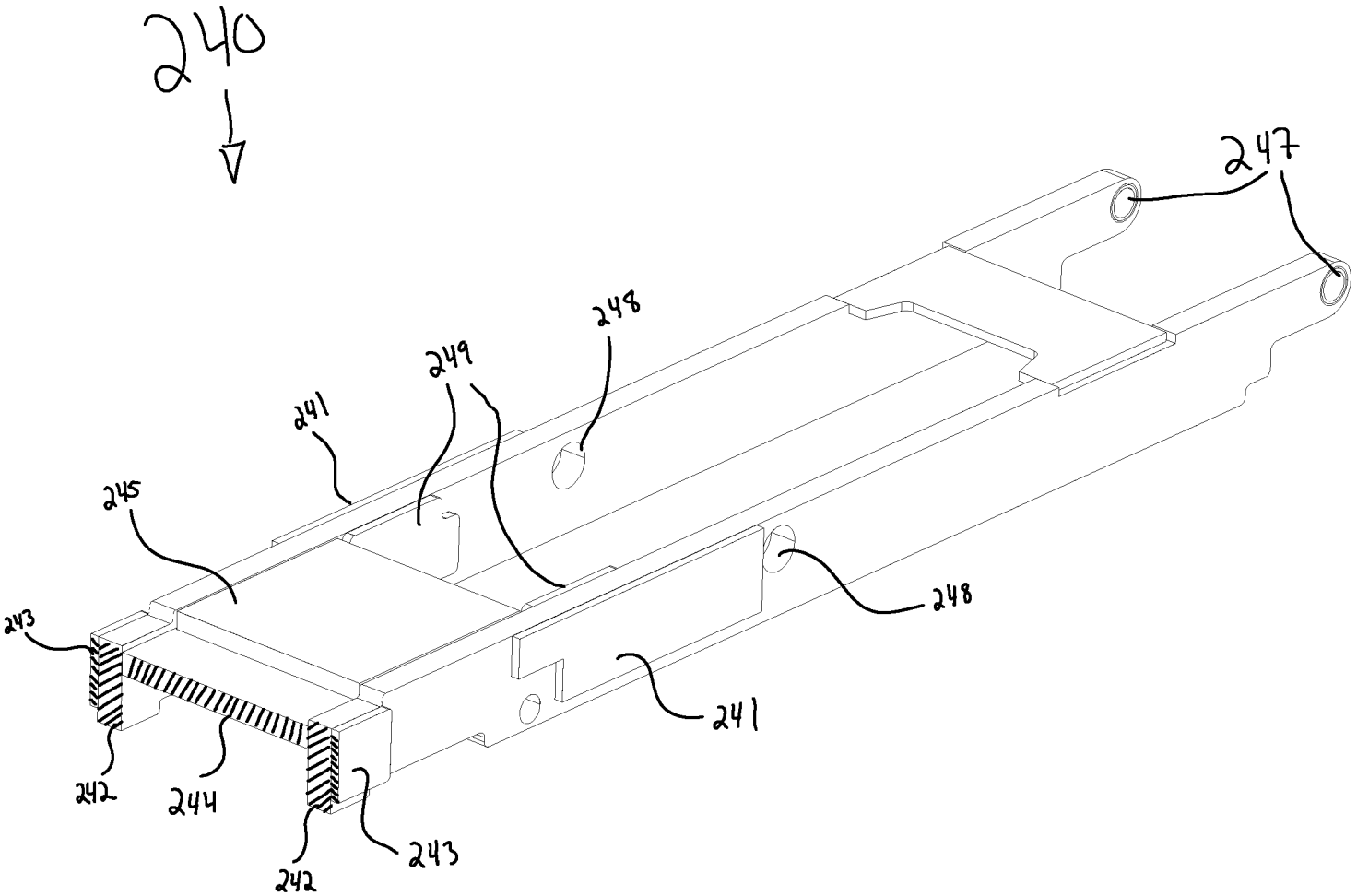
FIG. 4 is a cross-sectional perspective view of the upper lifting linkage assembly of FIG. 1.

FIG. 4 further illustrates upper linkage assembly (240) in a view sectioned through reinforcement plate (243) near bottom mounting portion (246) of upper links (242). In the plane of the section, it can be seen that reinforcement plate (243) runs alongside a portion of each upper link (242), supplementing its strength in this high-stress region without incurring the expense and additional size and weight that would result from having a reinforcement plate that extended the full length of upper link (242).

Figure 5:
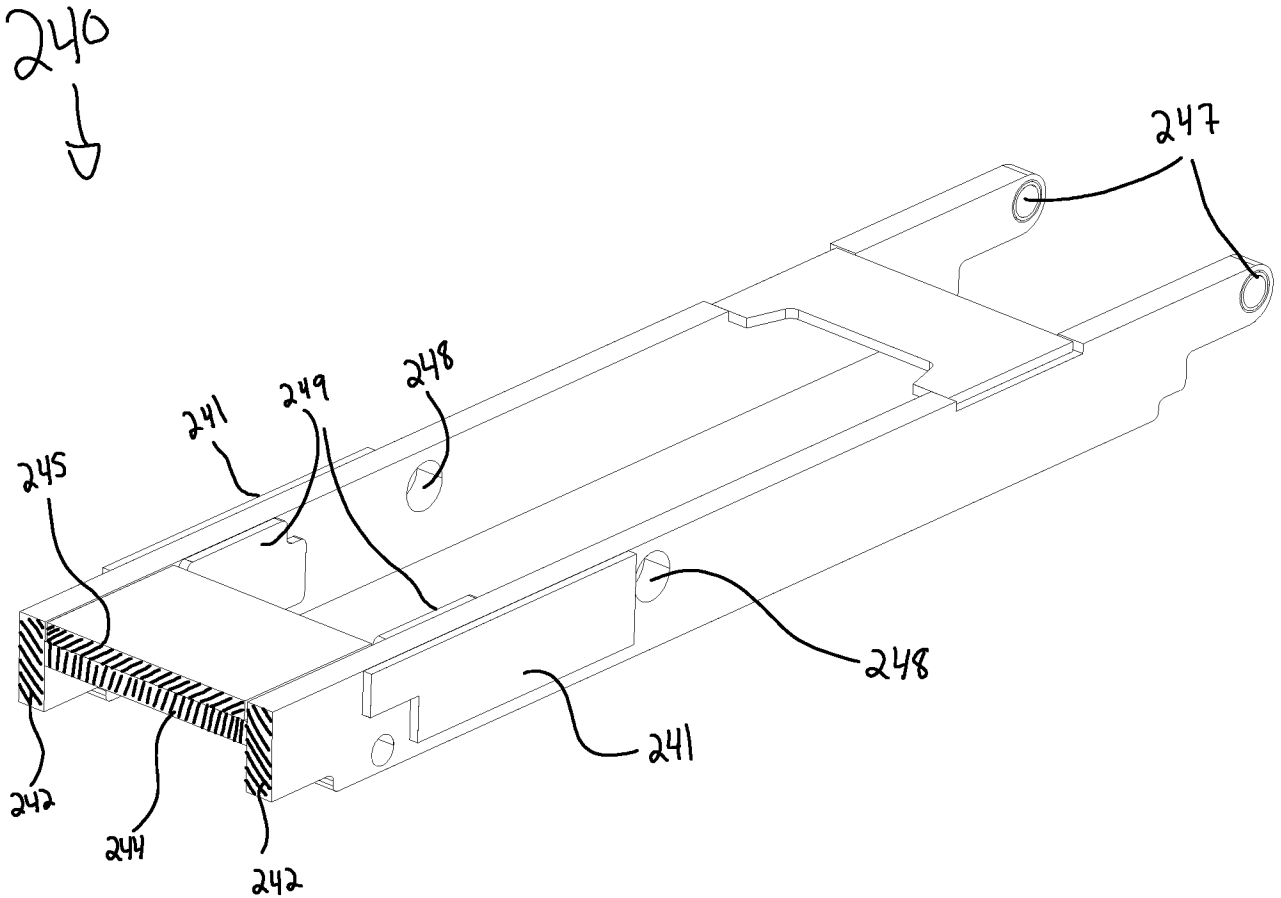
FIG. 5 is another cross-sectional perspective view of the upper lifting linkage of FIG. 1.

In FIG. 5, upper linkage assembly (240) is shown with a section plane through reinforcement plate (245), the mounting bracket (244) it supports, and the upper links (242) it joins. As with reinforcement plates (243), reinforcement plate (245) is attached by welding, adhesive, or other attachment means as will occur to those skilled in the art in view of the present disclosure to provide structural reinforcement in a cost- and weight-efficient manner.

Figure 6:
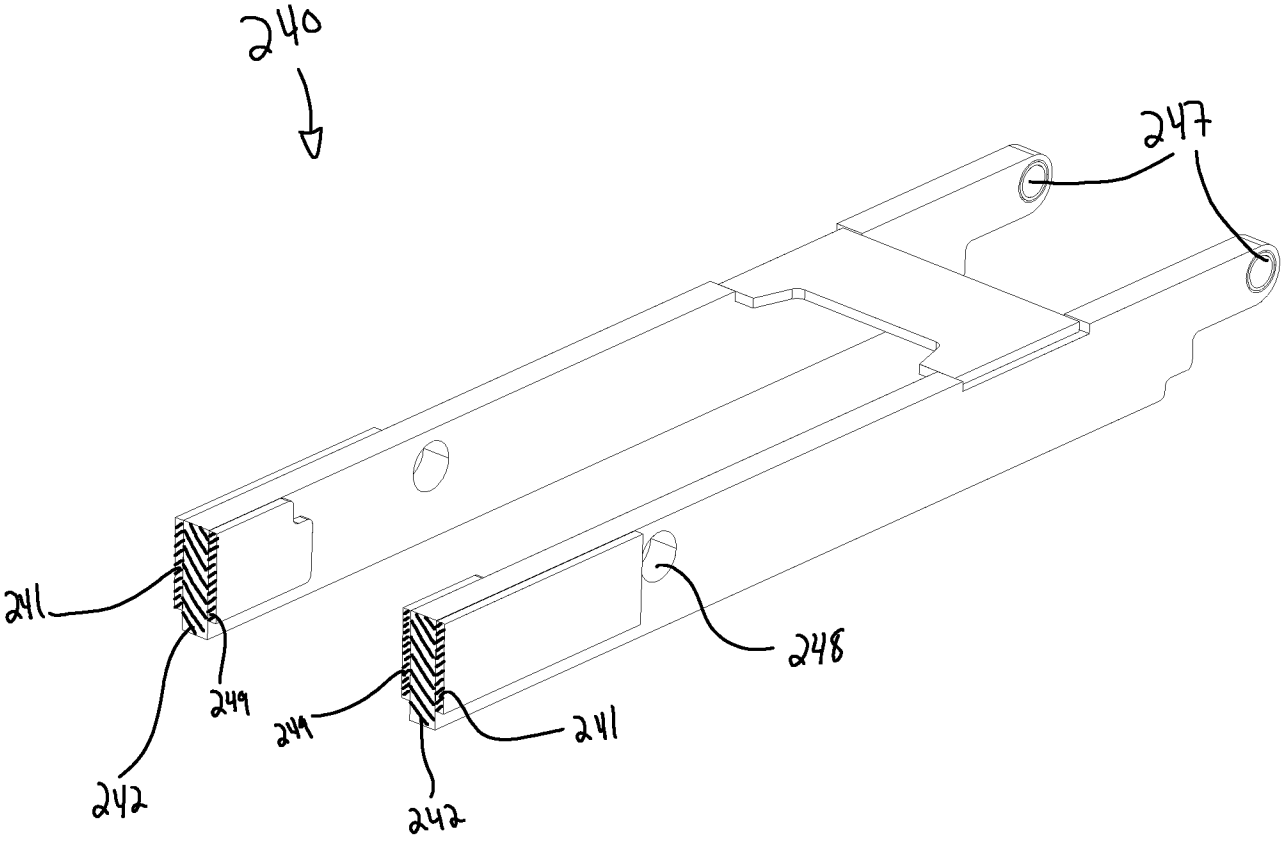
FIG. 6 is another cross-sectional perspective view of the upper lifting linkage of FIG. 1.

FIG. 6 shows upper linkage assembly (240) with the section plane through reinforcement plates (241, 249) in a region of upper links (242) below fastening bores (248). Reinforcement plates (241) are positioned on the outside surface of upper links (242), while reinforcement plates (249) are positioned along the inside surface of upper links (242). Each of these reinforcement plates (241, 249)

strengthens the upper link (242) to which it is attached, efficiently adding that strength with a minimum of additional weight and expense.

While in the current example, reinforcement plates (241, 243, 245, 249) are affixed to linkage assembly (240), it should be understood that reinforcement plates (241, 243, 245, 249) may be affixed to any other linkage assembly (232, 252, 260) or suitable location as would be apparent to one having ordinary skill in the art in view of the teachings herein. Additionally, while the current example shows reinforcement plates (241, 243, 245, 249) used within scissor lift assembly (210), reinforcement plates (241, 243, 245, 249) may be affixed to any suitable load bearing structural elements of any other suitable vehicle lift assembly, such as other hinged based vehicle lifts, two post lifts, or runway lifts. While in the current example, reinforcement plates (241, 243, 245, 249) are affixed to one planar side of linkage assembly (240), reinforcement plates (241, 243, 245, 249) may be affixed to multiple sides utilizing other suitable shapes with varying cross-sectional geometry, such as a sleeve or partial sleeve.

III. Experimental Data

Figure 7:
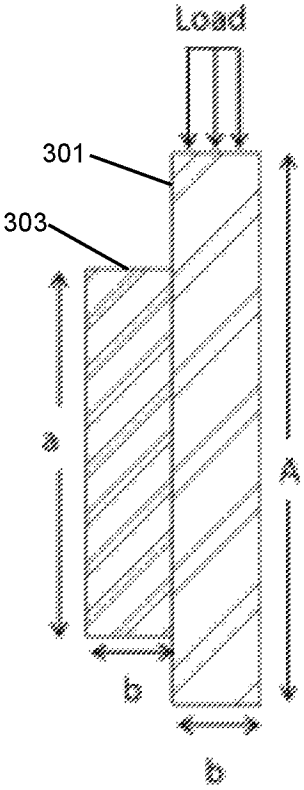
FIG. 7 is a front elevational view of an exemplary high strength composite structure experiencing a vertical bending load.

Two test configurations were manufactured according to FIG. 7. In the first configuration, load-bearing member (301) was made of low-strength, (ASTM) A36 steel with length (A) of 3.5 inches and width (b) of 0.75 inches. Stiffener member (303) was made of high-strength, (ASTM) A572, GR50 steel with length (a) of 2.875 inches. In the second configuration, stiffener member (303) was made out of the same low-strength, (ASTM) A36 steel as load-bearing member (301).

A load was then applied to load-bearing member (301) as indicated in FIG. 7. The first configuration yielded at 46,900 pounds of force, while the second configuration yielded at 41,400 pounds of force. Thus, use of high-strength material in the stiffener—even when the load was not directly applied thereto—improved the load-bearing capacity of load-bearing member (301) by 13.3%.

IV. Additional Embodiments

Figure 8:
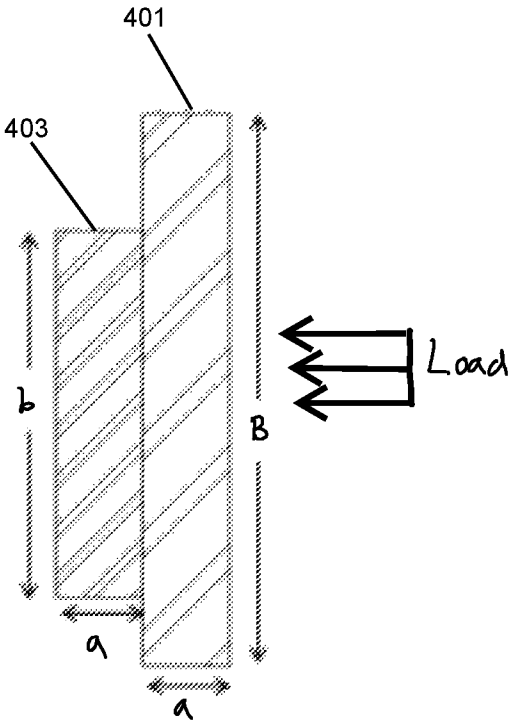
FIG. 8 is a front elevational view of the exemplary high strength composite structure of FIG. 7 experiencing a lateral bending load.

In other embodiments, a side-oriented load (illustrated for example in FIG. 8), torsion, strain, or other force on load-bearing member (401) is likewise better supported when a high-strength stiffener (403) is attached to load-bearing member (401) then when a low-strength stiffener (403) is used. Therefore, various portions of scissor lift assemblies (210) may be reinforced using reinforcement plates of high-strength steel to great benefit without the cost in space, expense, and/or additional weight that comes with other strengthening approaches. Similarly, the reinforcement techniques described herein can be applied to arms of two-post lifts and runways of runway lifts, as will be understood by those skilled in the art in view of the present disclosure.

We claim:

1. A vehicle lift assembly comprising:

(a) a base member;

(b) a vehicle contact member configured to move vertically relative to the base member, wherein the vehicle contact member is configured to contact a vehicle in order to lift the vehicle relative to the base member;

(c) an actuation assembly configured to drive the vehicle contact member relative to the base member; and (d) a lifting linkage assembly connecting the actuation assembly with the vehicle contact member, wherein the linkage assembly comprises:

(i) a first link defining a first length, and (ii) a first reinforcement plate affixed to the first link, wherein the first reinforcement plate extends as a solid plate along a second length parallel to the first length, and the second length is shorter than the first length.

2. The vehicle lift assembly of claim 1, wherein:

the lifting linkage assembly further comprises a second link and a second reinforcement plate, the second link extends parallel with the first link, the second link defines a third length, the second reinforcement plate is affixed to the second link and is a solid plate, the second reinforcement plate extends along a fourth length, and the fourth length is shorter than the second length.

3. The vehicle lift assembly of claim 2, wherein the lifting linkage assembly further comprises a mounting bracket connecting the first link with the second link.

4. The vehicle lift assembly of claim 3, wherein the lifting linkage assembly further comprises a third reinforcement plate affixed to the mounting bracket, and the third reinforcement plate is a solid plate.

5. The vehicle lift assembly of claim 3, wherein:

the first link has a first inside surface and a first outside surface, the second link has a first interior face and a second exterior face, and the first inside surface and the first interior face are connected to the mounting bracket.

6. The vehicle lift assembly of claim 5, wherein the first reinforcement plate is affixed to the first inside surface, and the second reinforcement plate is affixed to the first interior face.

7. The vehicle lift assembly of claim 6, wherein the lifting linkage assembly further comprises:

a third reinforcement plate affixed to the first outside surface, and a fourth reinforcement plate affixed to the second exterior face.

8. The vehicle lift assembly of claim 7, wherein the third reinforcement plate defines a fifth length, the fourth reinforcement plate defines a sixth length, and the fifth length equals the sixth length.

9. The vehicle lift assembly of claim 2, wherein the first reinforcement plate and the second reinforcement plate are parallel.

10. The vehicle lift assembly of claim 2, further comprising a stabilizing linkage assembly, wherein:

the stabilizing linkage assembly comprises a third link and a fourth link;

the fourth link extends in a parallel relationship with the third link, and the third link and the fourth link are pivotally coupled with the lifting linkage assembly and the vehicle contact member.

11. The vehicle lift assembly of claim 2, wherein:

the lifting linkage assembly further comprises a second pair of elongated links, the second pair of elongated links comprising a third link and a fourth link, the second pair of elongated links extending in parallel with each other, the third link is pivotally coupled to both first link and the base, and the fourth link is pivotally coupled to both the second link and the base.

12. The vehicle lift assembly of claim 2, wherein the fourth length defined by the first reinforcement plate equals the fourth length defined by the second reinforcement plate.

13. The vehicle lift assembly of claim 1, wherein the actuation assembly comprises a hydraulic actuator.

14. The vehicle lift assembly of claim 13, wherein the hydraulic actuator has a first end and a second end and is:

pivotally coupled to the base member at the first end, and coupled to the lifting linkage assembly at the second end.

15. The vehicle lift assembly of claim 1, wherein the first reinforcement plate is welded to the first link and the second reinforcement plate is welded to the second link.

16. The vehicle lift assembly of claim 1, wherein the first pair of longitudinally extending links are made out of a first steel having a first yield strength, wherein the first reinforcement plate and the second reinforcement plate are made out of a second steel having a second yield strength, wherein the first yield strength is lower than the second yield strength.

17. The vehicle lift assembly of claim 16, wherein the lower-strength steel is a A36 steel and the higher-strength steel is a A572, GR50 steel.

18. A vehicle lift assembly comprising:

(a) a base;

(b) a vehicle contact member configured to contact a vehicle and move the vehicle vertically relative to the base member;

(c) an actuation assembly configured to drive the vehicle contact member relative to the base; and (d) a load-bearing assembly coupling the actuation assembly with the vehicle contact member, wherein the load-bearing assembly comprises:

(i) a connection member attached to the actuation assembly and the vehicle contact member, and (ii) a high-strength reinforcement member affixed to the connection member, wherein the high-strength reinforcement member is a solid plate and is stronger than the connection member.

19. The vehicle lift assembly of claim 18, wherein the connection member is made of a lower-strength steel and the high-strength reinforcement member is made of a higher-strength steel.

20. A vehicle lift assembly comprising:

(a) a base;

(b) a vehicle lift member configured to contact a vehicle and vertically actuate the vehicle relative to the base from a lowered position to a raised position;

(c) an actuation assembly configured to vertically actuate the vehicle lift member from the lowered position to the raised position;

(d) a linking assembly coupling the actuation assembly to the vehicle lift member, wherein the linking assembly comprises a first link, a second link, and a connector plate, the first link and the second link extend in parallel, and the connector plate is affixed to both the first link and the second link; and (e) a reinforcing member configured as a solid plate affixed to the connector plate.

* * * * *